US005735414A

United States Patent [19]

Lo

[11] Patent Number: 5,735,414

[45] Date of Patent: Apr. 7, 1998

[54] SWIVEL-TYPE COAT HANGER ASSEMBLY

[76] Inventor: Chiu-hsiang Lo, No. 20, Lane 305, Sec. 3, Chungshan Rd., Lilin Village, Tantzu Hsiang, Taichung Hsien, Taiwan

[21] Appl. No.: 681,802

[22] Filed: Jul. 29, 1996

[51] Int. Cl.[6] ..... A47F 7/00

[52] U.S. Cl. ..... 211/162

[58] Field of Search ..... 211/162, 122, 211/113, 115; 312/267, 268, 319.7

[56] References Cited

U.S. PATENT DOCUMENTS

| | | | |
|---|---|---|---|
| 3,780,852 | 12/1973 | Weiss et al. | 211/122 |
| 4,484,288 | 11/1984 | Riemenschneider | 312/268 X |
| 4,625,874 | 12/1986 | Abe et al. | 211/122 |
| 5,062,536 | 11/1991 | Tsai | 211/162 |
| 5,065,872 | 11/1991 | Simon | 211/122 |
| 5,207,335 | 5/1993 | Voelz | 211/122 |
| 5,285,910 | 2/1994 | Chen | 211/162 |
| 5,305,890 | 4/1994 | Ishikawa | 211/162 X |

*Primary Examiner*—Alvin C. Chin-Shue
*Assistant Examiner*—Sarah Purol
*Attorney, Agent, or Firm*—Quarles & Brady

[57] ABSTRACT

A hanger assembly includes at least one upright post having a lower end portion fixedly mounted on a base. An upper bracket includes at least one supporting brace fixedly mounted on an upper end portion of the upright post, and an annular track fixedly mounted on the supporting brace. At least one suspension frame includes a top rack slidably mounted on the annular track, and a bottom rack slidably mounted on the base.

5 Claims, 7 Drawing Sheets

SWIVEL-TYPE COAT HANGER ASSEMBLY

FIELD OF THE INVENTION

The present invention relates to a hanger assembly, and more particularly to a swivel-type coat hanger assembly.

BACKGROUND OF THE INVENTION

A conventional coat hanger assembly can be used for suspending articles such as clothes, coats and the like, however, such a conventional coat hanger assembly is not easily assembled and dismantled, thereby greatly causing an inconvenience when being assembled and dismantled.

The present invention has arisen to mitigate and/or obviate the disadvantage of the conventional coat hanger assembly.

SUMMARY OF THE INVENTION

The primary objective of the present invention is to provide a swivel-type coat hanger assembly easily assembled and dismantled, thereby being suitable for manual operation by a user.

In accordance with one aspect of the present invention, there is provided a hanger assembly with a base. At least one upright post has a lower end portion fixedly mounted on the base. An upper bracket includes at least one supporting brace fixedly mounted on an upper end portion of the upright post, and an annular track fixedly mounted on the supporting brace. At least one suspension frame includes a top rack slidably mounted on the annular track, and a bottom rack slidably mounted on the base.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 1:
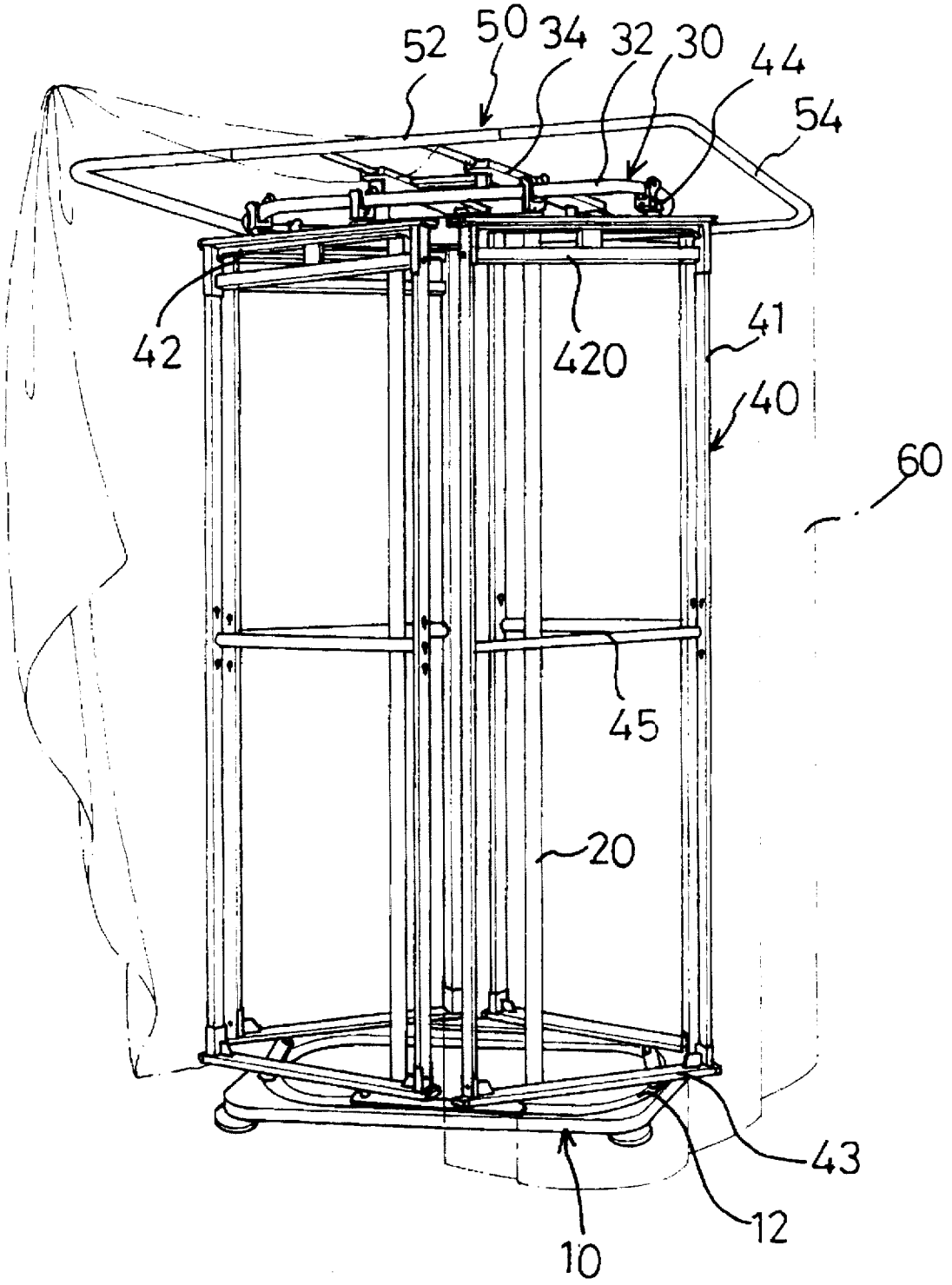
FIGS. 1 and 2 are perspective views of a hanger assembly in accordance with the present invention.
Figure 2:
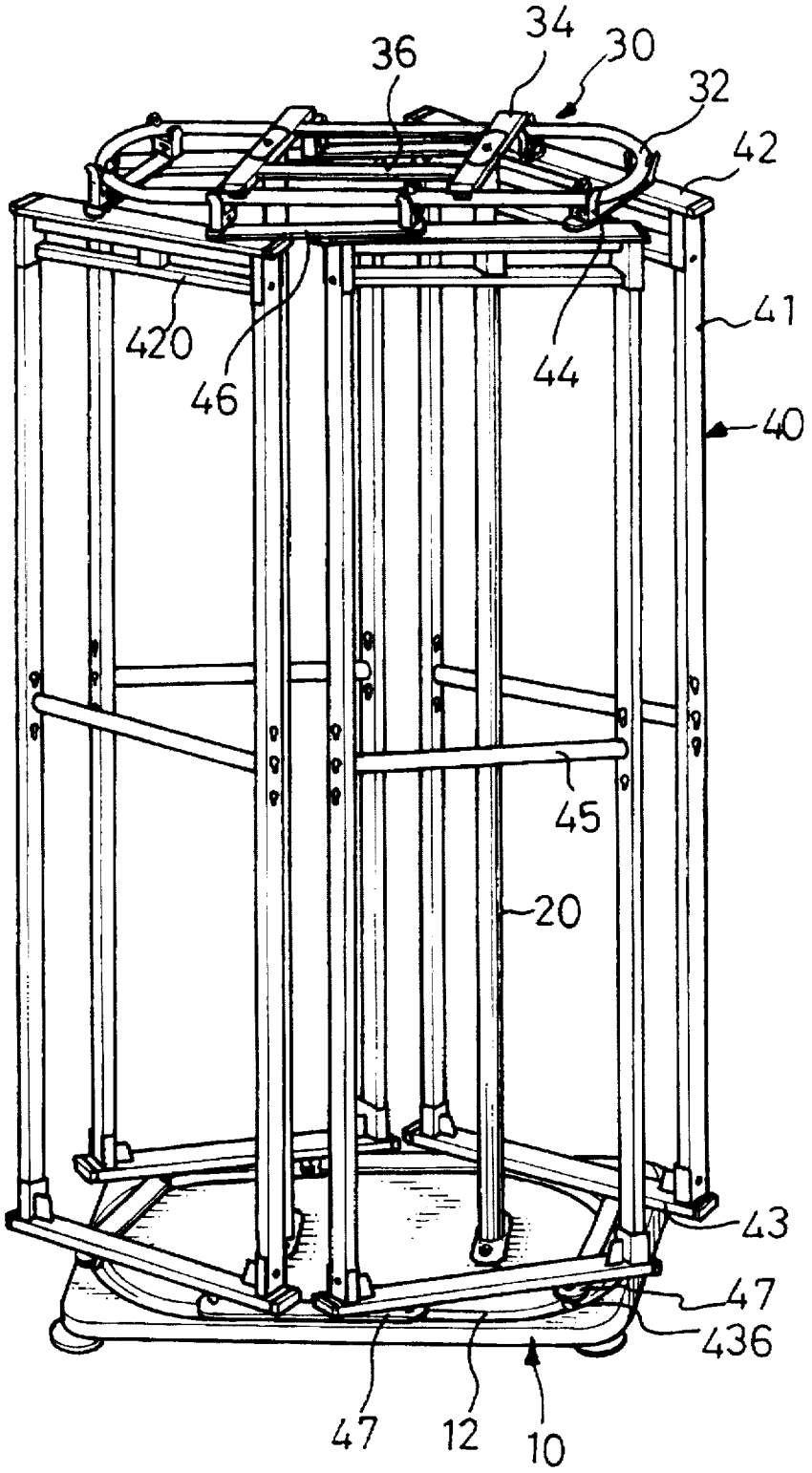

Referring to the drawings and initially to FIGS. 1 and 2, a swivel-type coat hanger assembly in accordance with the present invention is provided for suspending articles such as clothes, coats and the like.

In general, the hanger assembly comprises a base 10, two upright posts 20 each having a lower end portion fixedly mounted on the base 10, an upper bracket 30 including two supporting braces 34 each fixedly mounted on an upper end portion of each of the two upright posts 20, and an annular track 32 fixedly mounted on the two supporting braces 34, and a plurality of suspension frames 40 each including a top rack 42 slidably mounted on the annular track 32, and a bottom rack 43 slidably mounted on the base 10.

Figure 3:
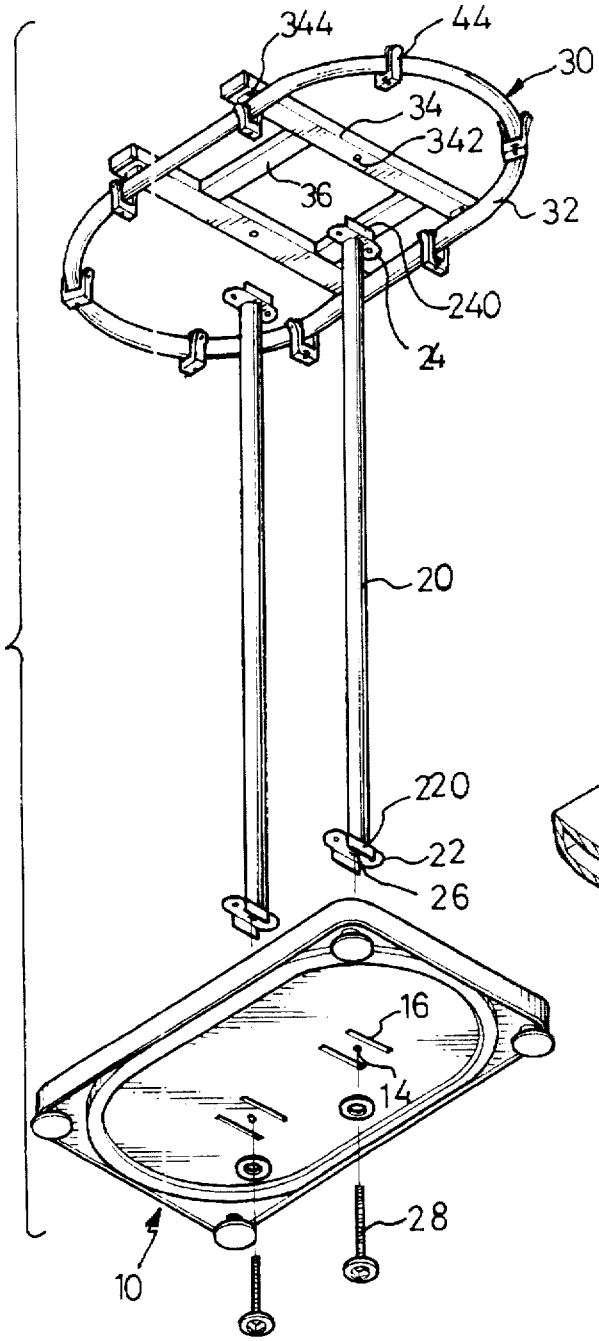
FIG. 3 is an exploded view showing two upright posts engaging with a base and an upper bracket.
Figure 4:
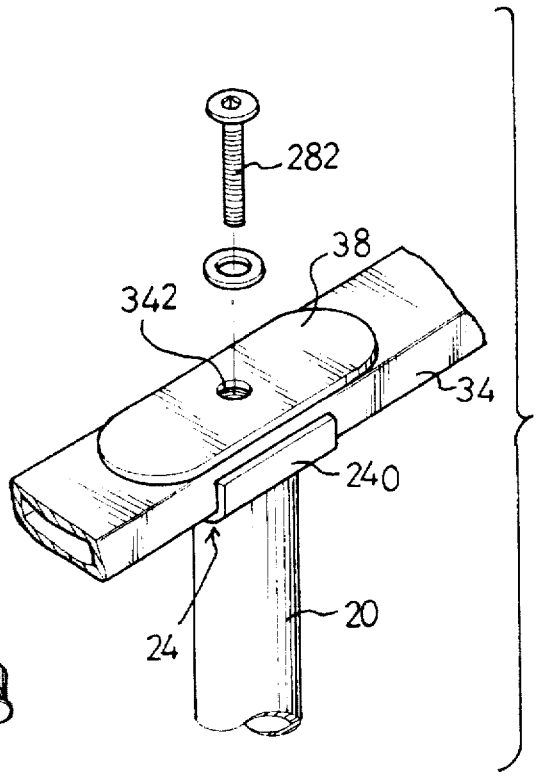
FIG. 4 is an partially exploded view showing a supporting brace engaging with an upright post.

Referring to FIGS. 3 and 4 with reference to FIGS. 1 and 2, the base 10 includes two pairs of elongate slots 16 defined therein, and two bores 14 defined therein and each located between two associated elongate slots 16.

Each of the two upright posts 20 has a plate 22 formed on the lower end portion thereof, a hole 26 defined by a threaded periphery of the plate 22, and two extensions 220 extending downwardly from the plate 22 and each received in an associated elongate slot 16. Two positioning bolts 28 each extend through an associated bore 14 and are each threadedly received in the associated hole 26, thereby securely mounting the lower end portion of each of the two upright posts 20 on the base 10.

Each of the two upright posts 20 also has a plate 24 formed on the upper end portion thereof, a hole (not shown) defined by a threaded periphery of the plate 24, and two extensions 240 extending upwardly from the plate 24 and each rested on an associated supporting brace 34.

Each of the two supporting braces 34 includes a reinforced strip 38 formed thereon and a bore 342 defined therein. Two linking beams 36 are each connected between the two supporting braces Two positioning bolts 282 each extend through an associated bore 342 and are each threadedly received in the hole of an associated plate 24, thereby securely mounting the upper end portion of each of the two upright posts 20 on the associated supporting brace 34.

Figure 5:
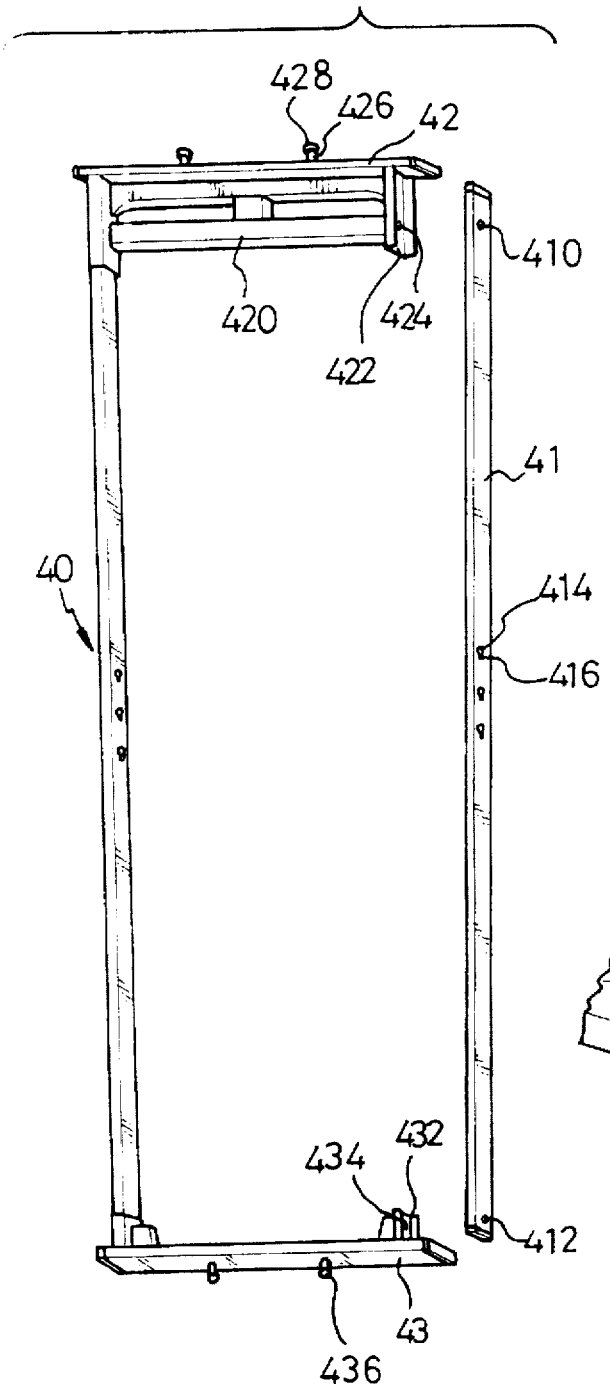
FIG. 5 is a partially exploded view of a suspension frame.
Figure 6:
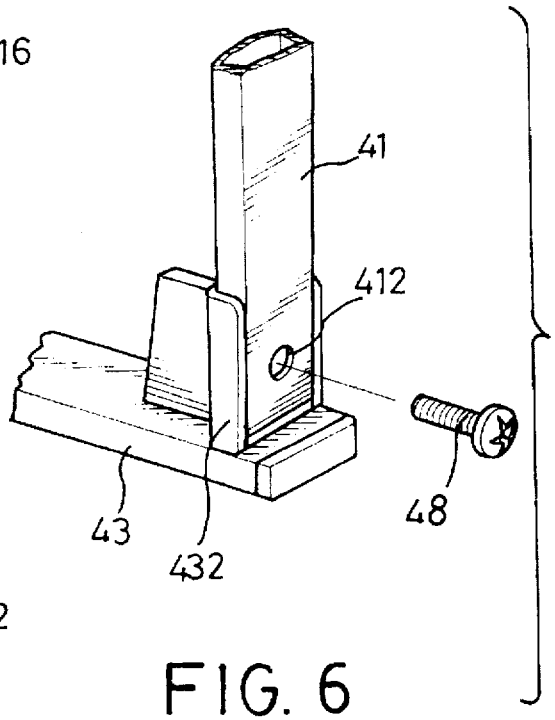
FIG. 6 is an partially exploded view showing an upright post engaging with a bottom rack.
Figure 7:
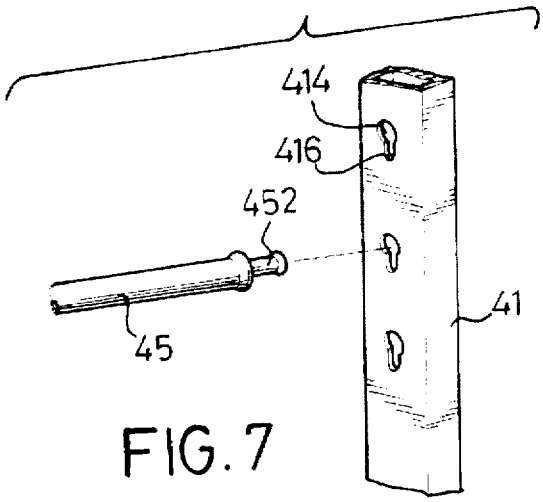
FIG. 7 is a partially exploded view showing a linking rod and an upright post.

Referring to FIGS. 5–7 with reference to FIGS. 1 and each of the suspension frames 40 includes two upright beams 41 each having an upper end fitted in an engaging bracket 422 which is formed on each of the two distal ends of the top rack 42 and has a hole 424 threadedly defined therein, and each having a lower end fitted in an engaging bracket 432 which is formed on each of the two distal ends of the bottom rack 43 and has a hole 434 threadedly defined therein. A plurality of suspension racks 420 are each mounted between two adjacent engaging brackets 422.

A first positioning bolt 48 extends through a bore 412 defined in the lower end of each of the upright beams 41 and is threadedly received in an associated hole 434, and a second positioning bolt (not shown) extends through a bore 410 defined in the upper end of each of the upright beams and is threadedly received in an associated hole thereby assembling each of the upright beams 41 with the top and bottom racks 42 and Particularly referring to FIG. 7, each of the upright beams 41 has a plurality of holes 414 defined in a mediate portion thereof and has a plurality of locking slots 416 defined therein and each communicating with an associated hole 414. A plurality of linking rods 45 are each connected between two adjacent upright beams 41 and each have two distal ends each having a lug 452 extending through an associated hole 414 and securely retained in the associated locking slot 416.

Figure 9:
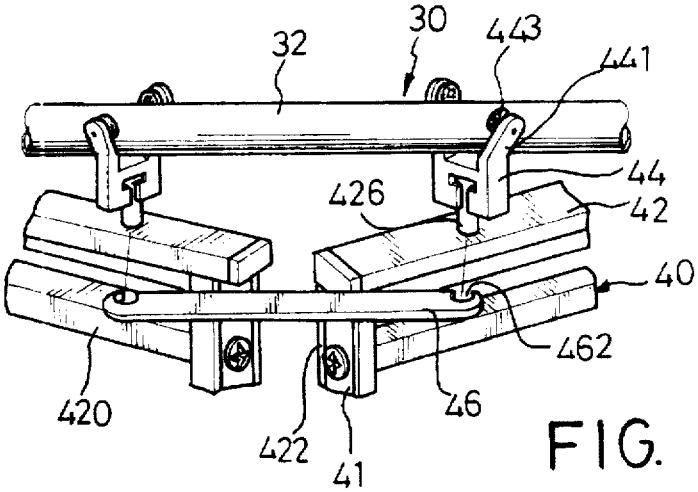
FIGS. 9 and 10 are broken away perspective views showing a linking lever connecting between two adjacent suspension frames.
Figure 8:
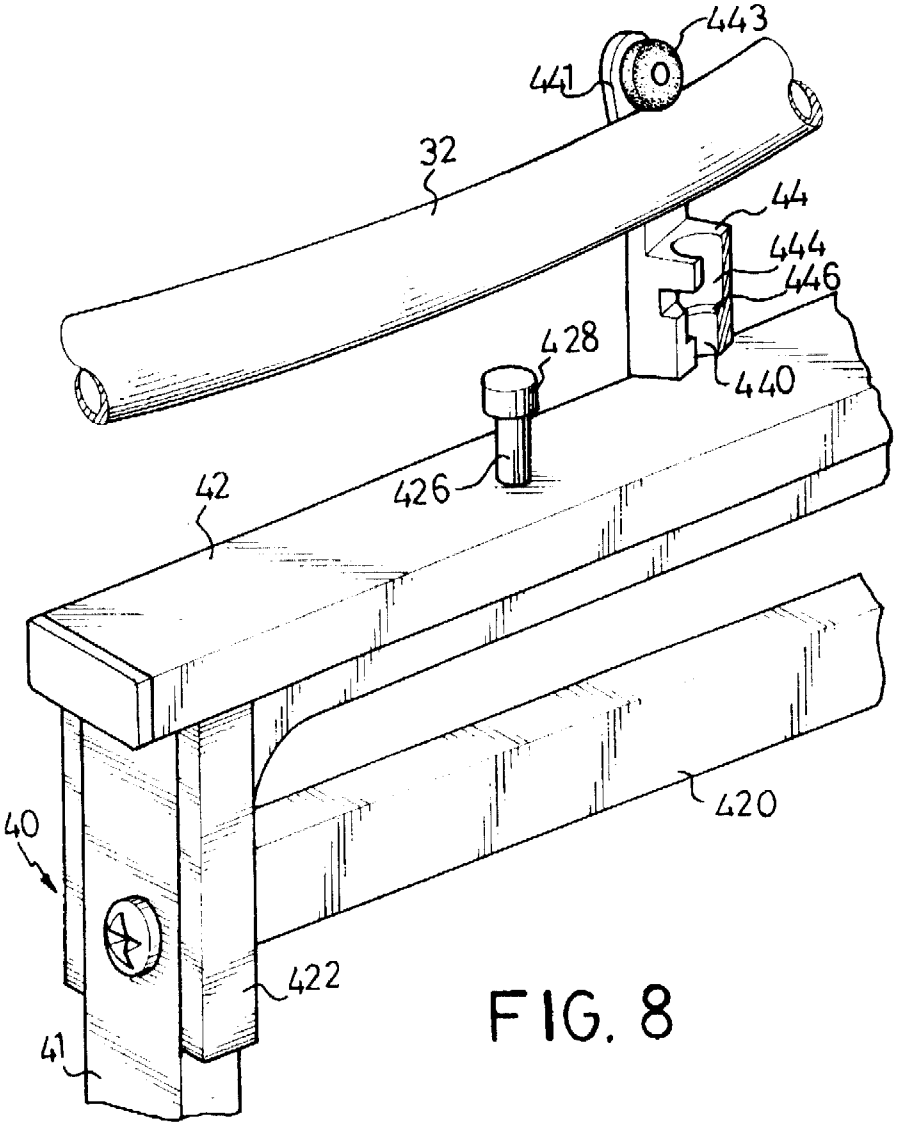
FIG. 8 is a broken away perspective view showing a sliding member engaging with an annular track and a top rack.

Referring to FIGS. 8 and 9 with reference to FIGS. 1 and 2, a plurality of sliding members 44 are each slidably mounted on the annular track 32. Two ears 441 each extend upwardly from each of the sliding members 44 and each abut on the annular track 32. Two rollers 443 are each laterally mounted on an associated ear 441 and are each rotatably mounted on a top face of the annular track 32 such that each of the sliding members 44 can slide along the annular track 32.

Each of the sliding members 44 has a first passage 440 defined in a lower portion thereof, a second passage 444 defined in an upper portion thereof and communicating with and having a diameter greater than that of the first passage 440, and a flange 446 formed on an inner wall thereof and located between the first and second passages 440 and 444.

The top rack 42 of each of the suspension frames 40 has two stubs 426 formed on an upperside thereof. Each of the stubs 426 extends through the first passage 440 and includes an enlarged head 428 securely received in the second passage 444 and stopped by the flange 446 such that each of the suspension frames 40 can slide along the annular track 32 by means of an engagement between each of the sliding members 44 and the associated stub 426.

Preferably, particularly referring to FIGS. 3 and 9, a plurality of spacers 344 are mounted between each distal end of each of the two supporting braces 34 and the top face of the annular track 32 for suspending each of the two supporting braces 34, thereby preventing the two supporting braces 34 from interfering with the sliding movement of each of the sliding members 44.

Figure 10:
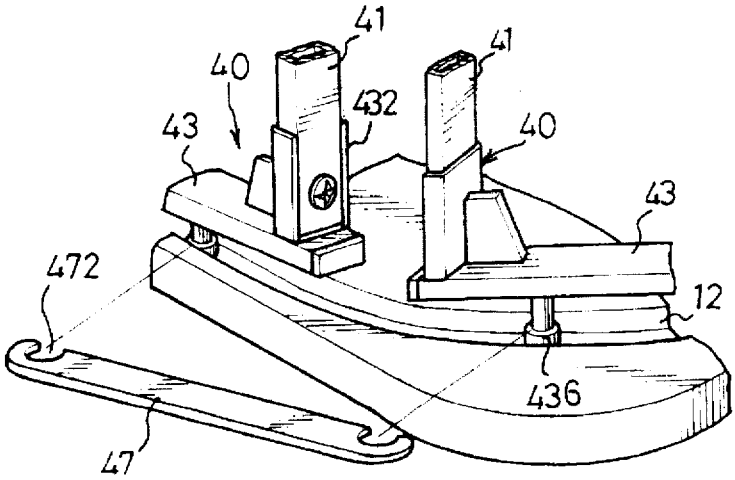
Figure 11:
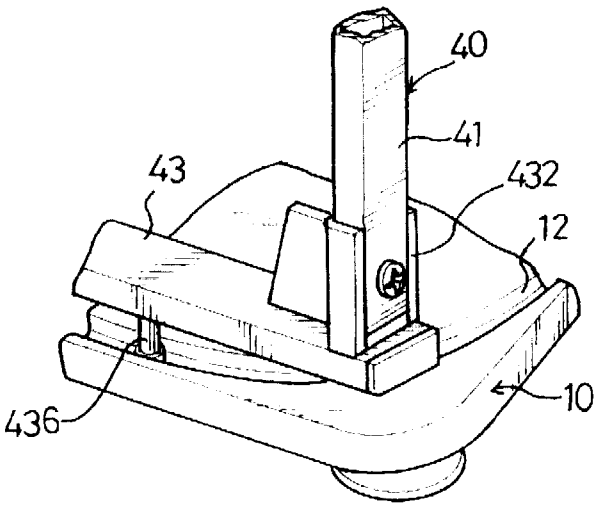
FIG. 11 is a broken away perspective view showing a bottom rack sliding along a base.

Referring to FIGS. 10 and 11 with reference to FIGS. 1 and 2, the base 10 has an annular groove 12 defined in an upperside thereof. The bottom rack 43 of each of the suspension frames 40 includes two stubs 436 formed on an underside thereof and slidably received in the annular groove 12 such that each of the suspension frames 40 can slide along the annular groove 12.

Preferably, particularly referring to FIGS. 9 and 10, a plurality of upper linking levers 46 are each connected between two adjacent top racks 42 and each have two distal ends each having a retaining recess 462 defined therein for securely receiving an associated stub 426. In addition, a plurality of lower linking levers 47 are each connected between two adjacent bottom racks 43 and each have two distal ends each having a retaining recess 472 defined therein for securely receiving an associated stub 436 such that each of the suspension frames 40 can be swiveled in concert.

Figure 12:
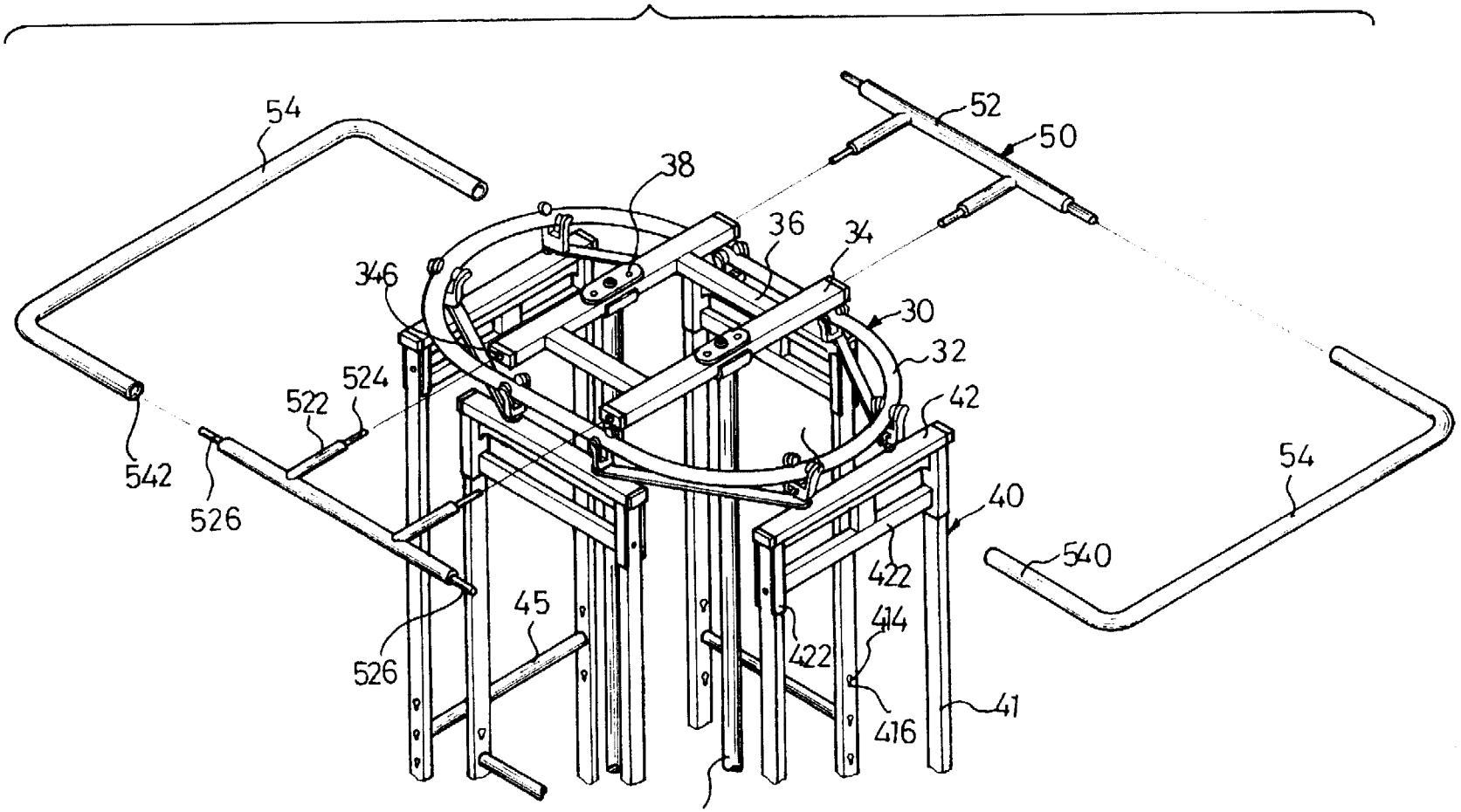
FIG. 12 is a partially exploded view showing an exploded supporting member.

Referring to FIG. 12 with reference to FIGS. 1 and 2, each of the two supporting braces 34 has two distal ends each having a hole 346 transversely defined therein.

A supporting member 50 includes two primary rods 52 each of which has two secondary rods 522 laterally formed thereon and each extending towards an associated distal end of each of the two supporting braces 34. Each of the secondary rods 522 has one reduced diameter distal end 524 securely received in an associated hole 346 of each of the two supporting braces 34.

Two U-shaped engaging brackets 54 each have two distal ends 540 each having a hole 542 defined therein for securely receiving one reduced diameter distal end 526 of each of the two primary rods 52, thereby accomplishing assembly of the supporting member 50 which is used to support a covering layer 60 for shielding the hanger assembly as shown in FIG. 1.

It should be clear to those skilled in the art that further embodiments of the present invention may be made without departing from the scope and spirit of the present invention.

What is claimed is:

1. A hanger assembly comprising:

a base defining at least two elongate slots therein, a bore defined in said base and located between said two elongate slots;

at least one upright post having a lower end portion fixedly mounted on said base, a plate formed on the lower end portion of said upright post and defining a hole in a threaded periphery thereof, two extensions extending downwardly from said plate and each received in a corresponding one of said two elongate slots;

a positioning member extending through said bore of said base and engaged in said hole of said plate, thereby fixing said plate on said base;

an upper bracket including at least one supporting brace fixedly mounted on an upper end portion of said upright post, and an annular track fixedly mounted on said supporting brace; and at least one suspension frame including a top rack slidably mounted on said annular track, and a bottom rack slidably mounted on said base.

2. The hanger assembly in accordance with claim 1, wherein said suspension frame includes at least one sliding member slidably mounted on said annular track, two ears extending upwardly from said sliding member and each abutting on said annular track, two rollers each laterally mounted on an associated said ear and each rotatably mounted on a top face of said annular track, and at least one stub formed on an upperside of said top rack and securely attached to said sliding member.

3. The hanger assembly in accordance with claim 2, wherein said sliding member has a first passage defined in a lower portion thereof and a second passage defined in an upper portion thereof and communicating with and having a diameter greater than that of said first passage, a flange formed on an inner wall of said sliding member and located between said first and second passages and, said stub extending through said first passage and having an enlarged head received in said second passage and stopped by said flange.

4. The hanger assembly in accordance with claim 1, wherein said base has an annular groove defined in an upperside thereof, and said bottom rack having at least one stub formed on an underside thereof and slidably received in said annular groove.

5. A hanger assembly comprising:

a base;

at least one upright post having a lower end portion fixedly mounted on said base;

an upper bracket including at least one supporting brace fixedly mounted on an upper end portion of said upright post, and an annular track fixedly mounted on said supporting brace, said supporting brace having two distal ends each defining a hole therein;

a supporting member including two primary rods each having at least one secondary rod laterally formed thereon and extending toward an associated distal end of said supporting brace, said secondary rod having one distal end securely received in an associated said hole of said supporting brace, and two U-shaped engaging brackets each having two distal ends each securely mounted on one distal end of each of said two primary rods; and at least one suspension frame including a top rack slidably mounted on said annular track, and a bottom rack slidably mounted on said base.

* * * * *